United States Patent [19]

Janssen

[11] Patent Number: 4,856,136

[45] Date of Patent: Aug. 15, 1989

[54] FLOCKED FOAM BRUSH

[75] Inventor: Robert I. Janssen, St. Paul, Minn.

[73] Assignee: Padco, Inc., Minneapolis, Minn.

[21] Appl. No.: 190,717

[22] Filed: May 6, 1988

[51] Int. Cl.[4] ..... A46B 15/00; A46B 5/02; B05C 17/10

[52] U.S. Cl. ..... 15/244.3; 15/210 R; 15/244.1

[58] Field of Search ..... 15/244.1, 244.3, 209 R, 15/210 R

[56] References Cited

U.S. PATENT DOCUMENTS

| | | | |
|---|---|---|---|
| 2,227,588 | 1/1941 | Kemp . | |
| 2,753,582 | 7/1956 | Fredericks . | |
| 2,870,471 | 1/1959 | Albert . | |
| 2,962,746 | 12/1960 | Heroy, Jr. et al. . | |
| 3,105,263 | 10/1963 | Ginter . | |
| 3,117,334 | 1/1964 | Imhof . | |
| 3,134,124 | 5/1964 | Horn . | |
| 3,214,778 | 11/1965 | Mathison . | |
| 3,215,263 | 11/1965 | Mathison . | |
| 3,353,203 | 11/1967 | Ginter . | |
| 3,366,988 | 2/1968 | Menkin et al. . | |
| 3,484,888 | 12/1969 | Davis . | |
| 3,562,838 | 2/1971 | Burton et al. . | |
| 3,599,265 | 8/1971 | D'Ercoli | 15/210 R |
| 3,605,165 | 9/1971 | Burns | 15/210 R |
| 3,797,062 | 3/1974 | LoCicero et al. . | |
| 4,127,911 | 12/1978 | Cupp et al. | 15/210 R |
| 4,134,173 | 1/1979 | Cupp et al. | 15/210 R |
| 4,155,139 | 5/1979 | Corcoran . | |
| 4,159,883 | 7/1979 | Mizell . | |
| 4,391,013 | 7/1983 | Janssen . | |
| 4,499,627 | 2/1985 | Gruns . | |
| 4,674,144 | 6/1987 | Palmeri . | |

*Primary Examiner*—Edward L. Roberts

*Attorney, Agent, or Firm*—Merchant, Gould, Smith, Edell, Welter & Schmidt

[57] ABSTRACT

A brush device is provided which has improved paint loading and smoothing characteristics. More specifically, a brush head member formed of flexible material suitable for adsorbing and releasing liquid paint includes an outer surface comprising fine denier fibers. The brush device is particularly well suited for liquids which require a smooth and even application.

16 Claims, 2 Drawing Sheets

FLOCKED FOAM BRUSH

FIELD OF THE INVENTION

This invention relates generally to applicators for paint and other fluids and more specifically to a paint brush with a foam head on which fine denier filaments are electrostatically oriented and adhesively attached.

BACKGROUND OF THE INVENTION

In the field of brush applicators there has been a longfelt need for brush heads which would allow greater amounts of paint and other materials to be loaded onto the brush without loss of precision in applying that paint or other material to the surface being worked upon.

Brushes constructed from different materials have attempted to solve this problem. Improvements over conventional long bristle or filament brushes include the development of foam brushes. Foam brushes which have a removable and replaceable foam head are well-known. In many instances, a foam head is held in place on the handle of the brush by a series of barbs on the perimeter of a section of the handle. The barbs hold the foam head onto the handle section, but may also allow selective removal of the head.

Other means of attaching foam heads to brush handles include: glue which bonds the head permanently to a handle; sonic welding of the foam head directly to the handle; as well as other methods. Preferably, a foam head is selectively removable for cleaning and/or replacement.

Various types of foam material may be used to fabricate a foam brush head. The variety of foams available include inexpensive polyether foams which swell when immersed in solvents or solvent-based paints, as well as more expensive polyester foams which are more color stable and more stable in solvents, when compared with polyethers. Ester foams are usually constructed of a web or skeleton of multihedral shaped cells joined together. A foaming process during manufacture allows a thin film of plastic to connect the perimeters of each of the planes of the cells. Also, some foam brushes are fabricated from an ester that has been reticulated. The reticulation process removes the above described plastic web leaving only the skeleton of the ester. A reticulated ester foam brush allows for a much freer flow of particles through the head of the brush making it generally more absorbent.

Although paint brushes made from foam heads represent substantial improvement over the prior art, the foam brushes also contain limitations. For example, due to the excellent absorption characteristics of advanced foam heads, paint is absorbed into the foam and is not easily released. Also, the quality or evenness of the paint which issues from a foam head brush depends to a large degree on the precision with which the leading edge of the foam head is fabricated. Typically, foam heads are used to apply enamels, urethanes, and other glossy surface liquids that, preferably, require a smooth even application. Therefore, the above disadvantages of foam heads are accentuated by the types of liquids which are commonly applied by these heads.

One method of improving the smoothing characteristics of a paint applicator is illustrated in U.S. Pat. No. 3,117,334, which issued to P. V. Imhof on Jan. 14, 1964, and wherein a piece of mohair is adhesively bonded to a plastic applicator. A similar method of applying paint is shown in U.S. Pat. No. 4,674,144, issued to Joseph Palmeri on June 23, 1987, in which the paint applicator surface includes a first layer of foam upon which a nap or field of bristles is placed. A similar technique of utilizing stiff fibers attached to an underlying foam pad is disclosed in U.S. Pat. No. 4,391,013 issued to Craig R. Janssen on July 5, 1983. The fibers in the Janssen patent are attached to a finishing tool for finishing wall board tape joints and are coarse so as to function as abrasive agents in order to loosen and then smooth a surface of a tape joint. None of the above patents disclose a means for substantially improving the loading characteristics of a paint brush while simultaneously providing smoothing filaments which ensure a more precise application edge of the brush for delicate finishes.

SUMMARY OF THE INVENTION

A device is provided to facilitate the absorption and release of paint and other liquid coating materials. More specifically, the device is operable to assist in relatively precise and efficient application of paint and other materials to surface areas. In particular, the device provides improved loading characteristics of paint and other materials, and provides an improved means for smoothing paint and other materials which may require a brush that permits smooth, even application of such liquids. The device is particularly well suited for use with paints including enamels and urethanes.

Devices according to the present invention include: a brush device with a head member and means for holding the brush device. Preferably, the head member is constructed and arranged to provide means for improved loading and smoothing of liquids. Also, preferred embodiments include means for precise application of the liquids held on the brush to other surfaces. It will be understood from the detailed descriptions that the means for loading and smoothing of liquids by the present device includes fibers attached to the head member. The manner in which these fibers are attached to the brush provides major advantages in the construction and use of the device.

Devices according to the present invention comprise means for holding the head member. Although not entirely necessary, it is preferable that such holding means comprise a handle member having a gripping section and a head mounting section. It is desirable, although not required in order to achieve advantages of the present invention, that the gripping section be elongate and the head mounting section be a generally flat plate comprising an extension of the gripping section. In order to provide optimum gripping of the brush by a user, an elongate gripping section of generally about 10 cm in length and generally about at least 1 cm in width is provided. Although the dimensions of each brush may vary, an excellent grip is available to users according to the above general description. Further, a first end of the gripping section may include an aperture designed for hanging the brush device or for attaching a lanyard or similar retaining line.

The head mounting section of a preferred embodiment is generally in the shape of a plate. Preferably, the plate extends longitudinally from the gripping section of the device. At least one preferred approximate ratio of the length of the gripping section to the length of the head mounting section is about 2:1, however, such ratio may vary depending on the sizes of the head member and the intended use. The plate shape of a preferred head mounting section is wider than the gripping section. This relatively greater width provides some rigidity to the head member of the device. Also, the head mounting section is preferably designed to extend substantially throughout the length of the head member so as to provide improved control and precision to the head member.

The head mounting section of a preferred device is approximately rectangularly shaped; however, other shapes may be used. Moreover, a head mounting section may be provided which is not a plate but which permits similar advantages.

A brush device according to the present invention may include a fixed head member or a selectively removable head member. Generally, it is desirable to provide attaching means on a holding means or head mounting section which allows engagement of the head member. Attaching means may include a serrated edge of a head mounting section. The serrated edge provides a lateral extension from the head mounting section which engages and retains the head member thereon. Preferably, a head mounting section has several laterally extending serrations designed to engage cavity defining surfaces within a mounted head member. Advantages of a preferred construction include ease of assembly and disassembly, while providing sufficient engagement of the head member to properly use the device. A head member may also be permanently attached to the head mounting section by use of adhesives or sonic welding techniques.

The head member, in preferred embodiments, is constructed of a flexible material, such as polyurethane foam, suitable for absorbing and releasing liquids, such as paints, enamels, urethanes, and the like. Preferably, the head member is substantially rectangular in shape with a wedge-shaped forward tip, and flat top and flat bottom portions. A wedge-shaped forward tip provides improved precision in the application of paint or other materials.

The head member of a preferred brush according to the present invention includes means for improved loading and smoothing of paint and other materials. Preferably, the loading and smoothing means includes filaments or fibers attached generally perpendicularly to the outer surfaces of the head member. More particularly, the fibers may be constructed of a fine denier material. Materials such as nylon and rayon are preferable, however, other synthetic or natural materials may be used to achieve some similar effect. For example, other suitable materials include cotton and wool.

Major advantages are achieved by electrostatically orienting the relatively fine denier material in a generally perpendicular relation to a foam head member, however substantial advantage is also achieved by attaching the denier filaments in a non-electrostatic manner and in a non-perpendicular and in a non-perpendicular orientation. However, when such materials are bonded to a foam head member of a preferred device, significant improvements in liquid loading characteristics are provided. Also, relatively fine denier filaments or fibers which are perpendicularly oriented at a wedge-shaped tip of a brush provide more desirable smoothing capabilities for the brush with respect to liquids. This advantage is particularly useful with liquids such as enamels and urethanes. Other advantages of the above described flocking process, wherein fine denier fibers are perpendicularly oriented and attached to various parts of a brush head member, may be further understood from the detailed description.

Other embodiments of the device according to the present invention may include: a ratio of the thickness of a foam head member to the thickness of a handle gripping section being generally between about 1:1 and about 2:1; a handle gripping section being separated from a head mounting section by a circumferentially mounted skirt; and, fibers formed of precision cut fine denier material.

At least one advantage of a head member and handle gripping section ratio of thickness being between about 1:1 and about 2:1 is that the device may be more precisely positioned by a user when the user's gripping hand is approximately co-planar with a flat top side or bottom side of a preferred brush. This enables the user to visually align and control the brush and/or wedge-shaped brush tip to a precise application point.

The drawings constitute a part of this specification and include exemplary embodiments of the present invention, while illustrating various objects and features thereof. It will be understood that in some instances relative material thicknesses and relative component sizes may be shown or expressed exaggerated, to facilitate an understanding of the invention.

BRIEF DESCRIPTION OF THE DRAWINGS

While the specification concludes with claims particularly pointing out and distinctively claiming the subject matter regarded as forming the present invention, it is believed that the invention will be better understood from the following description taken in connection with the accompanying drawings in which.

DETAILED DESCRIPTION WITH PREFERRED EMBODIMENT

As required, detailed embodiments of the present invention are disclosed herein. It is to be understood, however, that the disclosed embodiments are merely exemplary of the invention, which may be embodied in various forms. Therefore, specific structural and functional details disclosed herein are not to be interpreted as limiting, but rather as a basis for the claims and as a representative basis for teaching one skilled in the art to variously employ the present invention in virtually any appropriately detailed system or structure.

Figure 1:
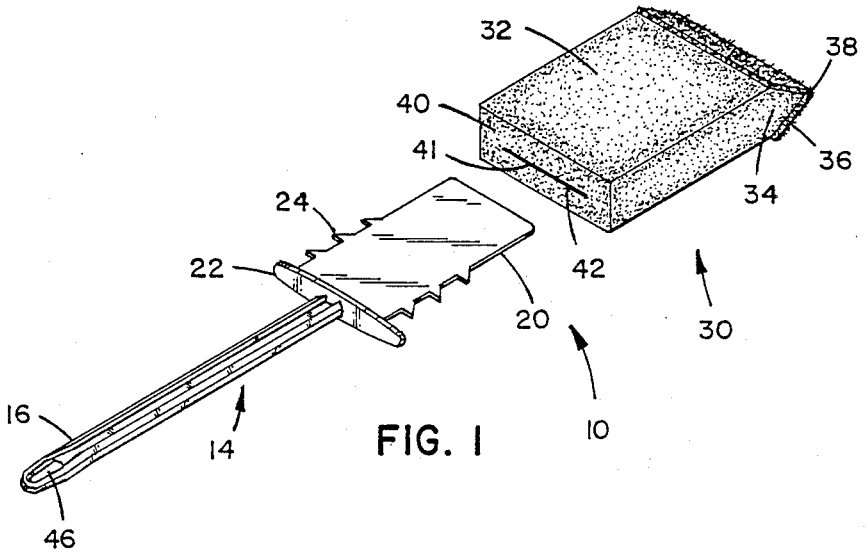
FIG. 1 is an exploded perspective view of a preferred brush according to the present invention with the handle member removed from the head member cavity; and showing a forward wedge-shaped tip on the head member having fine denier fibers perpendicularly attached thereto.
Figure 2:
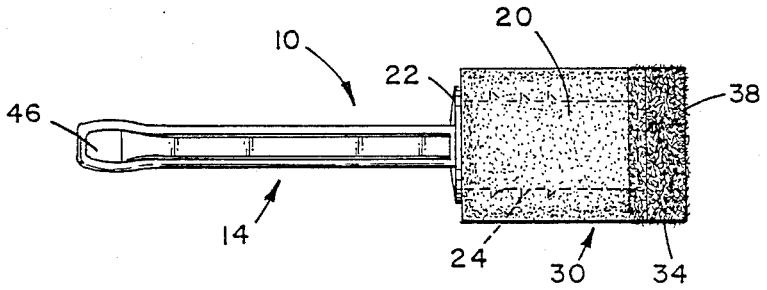
FIG. 2 is a top plan view of a preferred brush, analogous to FIG. 1, but with the handle member connected to the head member; and the head mounting section is shown within the head member cavity.
Figure 3:
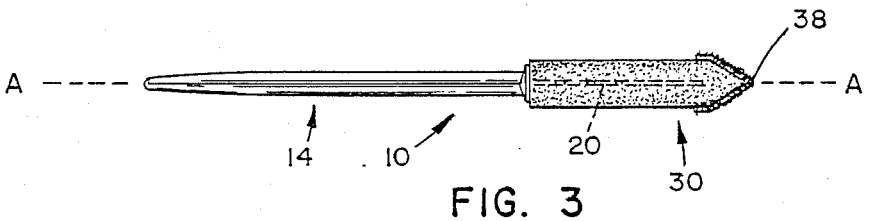
FIG. 3 is a side elevation view, analogous to FIG. 2, of a preferred brush.

Referring to FIG. 1, reference numeral 10 generally designates a device according to the present invention. In FIG. 1, the brush device 10 is shown in an exploded view to illustrate a preferred embodiment which is comprised of two members. A single member device is also readily usable with similar advantages. This particular preferred embodiment of FIG. 1 includes means for holding the brush comprising handle member 14 which is designed for gripping by an individual user of brush 10. Preferably, handle member 14 is comprised of a gripping section 16, a head mounting section 20, and a circumferential skirt 22 which separates gripping section 16 and head mounting section 20. Handle member 14 is preferably constructed of a lightweight, durable plastic, however it may be constructed of wood or other suitable material. Handle member 14 is preferably a molded material of sufficient strength, structure, and shape to provide support and control for a mounted head member designed for the application of paint and other coating materials. A head mounting section 20 according to this invention is preferably comprised of an extension from the gripping section 16 of handle member 14. This extension is illustrated in FIGS. 1–3, and is preferably a flat plate of generally rectangular shape. In a preferred device, head mounting section 20 may contain laterally extending serrations 24 designed to engage a mounted head member 30. Other engaging means include sonic welding or gluing. Circumferential skirt 22 may be provided as part of a preferred handle member 14 to permit separation of handle gripping section 16 from head mounting section 20. Circumferential skirt 22 may also be provided to allow abutting support for a mounted head member 30. Other embodiments of this invention may include different shaped protrusions forming a head mounting section and different means for attaching a head member to a head mounting section. Similarly, a gripping section may comprise various shapes and various attaching means. Further, a circumferential skirt may be unnecessary depending on the intended use of the brush.

A brush according to a preferred embodiment of this invention includes head member 30. Head member 30 may be fixed or removably and replaceably mounted on head mounting section 20 of handle member 14. Moreover, head member 30 may even comprise means for holding without need for a separate handle member 14.

Head member 30 is comprised of material which absorbs liquid paint and other materials, but which also readily releases those liquids for application onto a designated surface. A preferred material for construction of head member 30 of this invention is a polyurethane foam, however, other types of foam as well as other types of non-foam material may be substituted. Generally, a polyester foam is preferable over a polyether foam due to the polyester foam's relative color stability and relative overall stability when in contact with solvents. Further, polyether foams will often exhibit swelling when immersed in solvents or solvent-based paints; a characteristic which may not be desirable for precision painting applications.

A preferred embodiment of head member 30 of device 10 is formed of an ester foam material. Ester foams are comprised of a web or skeleton of multihedral shaped cells joined together. In the foam producing process a thin film of plastic connects the perimeters of each of the planes of the ester cells. Some foam brushes are fabricated from an ester that has been reticulated. The reticulation process removes the plastic web leaving only the skeleton of the cells. This process allows a much freer flow of liquid through a head portion of a reticulated foam brush, making it generally more absorbent.

Although reticulated polyester foam head members of paint brushes may significantly improve the paint loadout of brushes, substantial further improvement of that loadout characteristic may be achieved by use of the present invention. As shown in FIG. 1, a part of head member 30 is constructed of a conventional reticulated foam material 32. Also, head member 30 is preferably generally in the shape of a rectangular applicator with a wedge-shaped forward tip 34. This wedge-shaped forward tip 34 is coated with a second layer 36 of material. Second layer 36 is comprised of fine particles of material attached to the underlying head member. Second layer 36 is applied using flocking technology. A preferred means of attaching the fine particles includes orienting the particles generally perpendicularly to the underlying head member.

Flocking allows for the coating of a surface with any of a variety of materials and by a variety of methods. Flocking materials which could be successfully employed on head member 30 of a brush device 10 to provide a painting surface include fibers of either organic or synthetic origin, such as cotton, wool, rayon, nylon, plastic, or other materials. These materials may be chopped, cut to random lengths, or cut to precision lengths. The flocking material may be applied to a substrate and then attached to a paint brush head member which has been coated with an adhesive. Another method is to sift the materials and then attract the flocking material to an adhesively coated head member using electrostatic charges.

In electrostatic coating, the flocking fibers are coated with a medium to make them electrically conductive or charged. The head member of a brush is coated with an adhesive. The adhesively coated head member is then passed through a static charged field and the flocked fibers are electronically drawn to it, causing them to become embedded in the head member adhesive surface. The static electricity makes the fibers erect and stand straight on end, orienting the fibers generally perpendicularly to the surface of a head member. It will be appreciated that electrostatic flocking is known in the art and forms no part of this invention per se.

Accordingly, foam material 32 of a preferred embodiment of brush device 10 includes a flocked second layer 36 applied to wedge-shaped forward tip 34 and forward smoothing tip 38. This second layer 36 of material is preferably fabricated from a precision cut relatively fine denier synthetic fiber, such as nylon or rayon, which has been electrostatically flocked. Second layer 36 provides greatly enhanced paint loadout and smoothing characteristics for the area coated.

As further illustrated in FIG. 1, head member 30 of brush 10 contains a wedge-shaped forward tip 34 and preferably a flat-faced handle receiving end 40. Handle receiving end 40 may further contain an aperture 41 at a first end of a cavity 42 which extends to the interior of head member 30 and is defined by opposing inner surfaces of head member 30. Cavity 42 is preferably sized to receive head mounting section 20 of handle member 14.

As illustrated in FIG. 2, when head member 30 is fully mounted on head mounting section 20, the laterally extending serrations 24 of head mounting section 20 engage the cavity defining surfaces to retain head member 30 on handle member 14. As noted above, other means of attaching a head member to a handle member may be employed within the scope of this patent.

FIG. 2 also shows the manner in which head member 30 may abut against circumferential skirt 22 on one embodiment of handle member 14. In a preferred embodiment, head member 30 interior cavity 42 extends substantially throughout the entire length of head member 30. Therefore, when head member 30 is fully mounted on the handle member 14, head mounting section 20 extends approximately to the wedge-shaped forward tip 34. This provides improved stability for guiding the precision application of the forward smoothing tip 38. The combination of the flocked forward smoothing tip 38 and the extra reinforcement of the interior head mounting section 20 results in an even greater precision application and smoothing of paint. This feature of reinforcing the rigidity of smoothing tip 38 is also important due to the increased volume of paint which flocked wedge-shaped forward tip 34 is able to retain. The opposing surfaces of brush head member flocked surfaces define a volume, depicted in FIGS. 1–3 as wedge-shaped forward tip 34, having greater paint loading capabilities than portions of the head member not retained within the flocked surfaces. This extra volume of paint could result in undesirable bending of the head member due to the weight of the paint unless sufficient reinforcement is provided. The addition of second layer 36 comprised of flocked material provides further rigidity to wedge-shaped forward tip 34 and forward smoothing tip 38 to prevent the bending referred to above.

Head mounting section 20 of a preferred device 10 is generally in the shape of a plate. An approximate ratio of the length of handle gripping section 16 to the length of head mounting section 20 is generally about 2:1. Moreover, the plate shape of a preferred head mounting section 20 is preferably wider than gripping section 16 to provide added rigidity to mounted head member 30 and to enhance the overall control and precision use of device 10.

Figure 4:
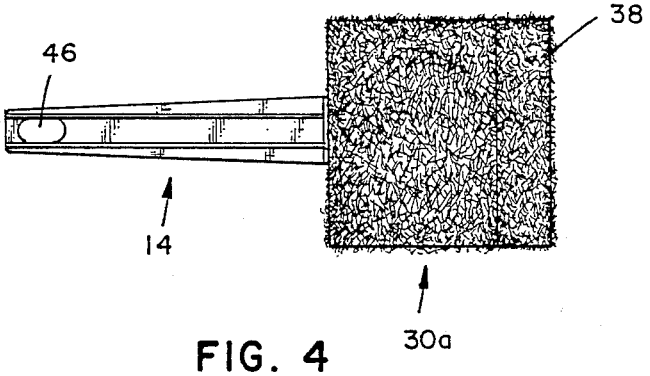
FIG. 4 is a top plan view of an alternate embodiment of a brush having fine denier fibers perpendicularly attached to the entire outer surface of the head member.

FIG. 1, FIG. 2, and FIG. 4. illustrate device 10 with handle member 14 having an aperture 46 extending through gripping section 16 so as to provide a means for easily hanging, storing, or carrying the brush device.

FIG. 3 is a side view of a preferred embodiment of brush device 10 with head member 30 fully mounted on handle member 14. Head mounting section 20 is shown extending substantially through the length of head member 30 to provide reinforcement to the flocked forward smoothing tip 38. FIG. 3 also illustrates the nearly co-planar relation of head member 30 with handle member 14. This generally co-planar relation allows users of the brush to easily align and control device 10 approximately along the longitudinal axis A of handle member 14 so as to more precisely direct forward smoothing tip 38. A substantially thicker head member may otherwise impair such precision and may require the user to view the application of the paint or other material from an angle substantially laterally offset from longitudinal axis A of the paint brush. Such a viewing requirement could result in overall degradation of the quality of the application of the paint or other materials to the desired surface area. Also, to provide optimum gripping of the brush, an elongate gripping section of at least about 10 cm in length and about at least 1 cm in width is desirable.

FIG. 4 illustrates an alternate embodiment of the present invention in which head member **30*a* is adhesively bonded to a head mounting section of handle member 14. Further, FIG. 4 shows head member 30*a* with substantially all outer surfaces having a flocked coating. By coating approximately all of the outer surfaces of a head member with fine denier flocked synthetic material, the paint loadout characteristics of the brush is generally increased quite substantially. Further, this alternate embodiment includes the advantage of the flocked forward smoothing tip 38**.

Figure 5:
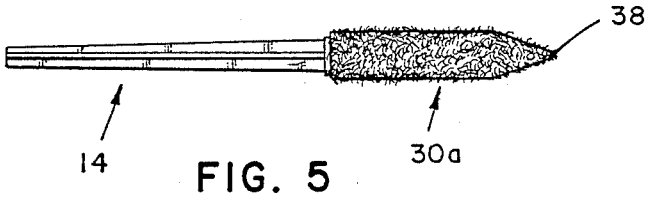
FIG. 5 is a side elevation view of a brush as depicted in FIG. 4.

FIG. 5 further illustrates the preferable coplanar relation of head member **30*a* to handle member 14**; this relation providing greater accuracy and control in the application and smoothing of paint with this invention.

It is to be understood that while certain embodiments of the present invention have been illustrated as described, the invention is not to be limited to the specific forms or arrangement of parts herein described and shown. The invention accordingly consists in the features of construction, combinations of elements, and arrangement of parts which will be exemplified in the construction described above and of which the scope of the invention will be indicated in the following claims.

What is claimed is:

1. A paint brush comprising:

(a) a handle member with a gripping section and a head mounting section, and, (b) a head member formed of a removable and replaceable foam material, said head member being substantially rectangular in shape with a wedge-shaped forward tip portion, and said head member having fibers attached perpendicularly thereto; and, (c) said fibers surround at least a portion of said head member and extend up at least a portion of opposite sides thereof with a portion of material of said head member disposed between said opposing sides defining a chamber of said head member disposed between opposing fiber bristles.

2. A paint brush according to claim 1, wherein said fibers are formed of fine denier material.

3. A paint brush according to claim 2, wherein said fibers are comprised of rayon.

4. A paint brush according to claim 2, wherein said fibers are comprised of nylon.

5. A paint brush according to claim 2, wherein said fibers are comprised of cotton.

6. A paint brush according to claim 2, wherein said fibers are comprised of wool.

7. A paint brush according to claim 2, wherein said fibers are electrostatically oriented and adhesively attached to said foam head member.

8. A paint brush comprising:

(a) a handle member with an elongated gripping section and a head mounting section, said head mounting section being a projection from said elongated gripping section, and said head mounting section having laterally extending serrations thereon; and, (b) a head member formed of a removable and replaceable foam material, said head member having interior surfaces defining a cavity therein, said cavity being sized to receive and selectively retain said head mounting section, said head member having a flat top portion and a flat bottom portion and flat side portions, and with a wedge-shaped forward tip, said wedge-shaped forward tip containing fine denier fibers attached generally perpendicularly thereto extending along a portion of opposed sides of said tip ; and (c) whereby said fibers provide improved paint loading and smoothing characteristics for said paint brush.

9. A paint brush according to claim 8, wherein the ratio of the thickness of said head member to the thickness of said elongated gripping section is between about 1:1 and 2:1.

10. A paint brush according to claim 8, wherein said elongated gripping section is separated from said head mounting section by a circumferentially mounted skirt, said skirt being attached to said handle member.

11. A paint brush according to claim 8, wherein said fibers are formed of precision cut fine denier material.

12. A paint brush according to claim 11, wherein said fibers are comprised of rayon.

13. A paint brush according to claim 11, wherein said fibers are comprised of nylon.

14. A paint brush according to claim 11, wherein said fibers are comprised of cotton.

15. A paint brush according to claim 11, wherein said fibers are comprised of wool.

16. A paint brush according to claim 11, wherein said fibers are electrostatically oriented and adhesively attached to said foam head member.

* * * * *